US008049436B2

(12) United States Patent
Wang et al.

(10) Patent No.: US 8,049,436 B2
(45) Date of Patent: Nov. 1, 2011

(54) DIMMER AND LIGHTING APPARATUS

(75) Inventors: Hao-Yuan Wang, Taipei County (TW); Hsien-Chung Chen, Taipei County (TW); Kwan Ho, Taipei County (TW)

(73) Assignee: Cal-Comp Electronics & Communications Company Limited, New Taipei (TW)

( * ) Notice: Subject to any disclaimer, the term of this patent is extended or adjusted under 35 U.S.C. 154(b) by 267 days.

(21) Appl. No.: 12/478,732

(22) Filed: Jun. 4, 2009

(65) Prior Publication Data

US 2010/0270948 A1 Oct. 28, 2010

(30) Foreign Application Priority Data

Apr. 24, 2009 (TW) ..... 98206957 U

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/291; 315/200 R; 315/246

(58) Field of Classification Search ..... None
See application file for complete search history.

(56) References Cited

U.S. PATENT DOCUMENTS 6,057,651 A * 5/2000 Usami ..... 315/291
7,781,982 B2 * 8/2010 Tatsumi ..... 315/291

* cited by examiner

*Primary Examiner* — Anh Tran
(74) *Attorney, Agent, or Firm* — Jianq Chyun IP Office

(57) ABSTRACT

A dimmer and a lighting apparatus are provided. The dimmer apparatus includes a rectifier unit, a controller, a voltage divider and a voltage converter. The rectifier unit rectifies an AC power and generates a first operating voltage. The voltage divider outputs a voltage division of the first operating voltage. The controller integrates the voltage division to obtain an average voltage, and provides a pulse width modulation (PWM) signal based on the average voltage. The voltage converter drives a light emitting diode (LED), and adjusts a driving voltage and a driving current of the LED according to the PWM signal. Wherein, the controller also adjusts the PWM signal according to a feedback signal generated by the voltage converter.

12 Claims, 5 Drawing Sheets

200

700

DIMMER AND LIGHTING APPARATUS

CROSS-REFERENCE TO RELATED APPLICATION

This application claims the priority benefit of Taiwan application serial no. 98206957, filed Apr. 24, 2009. The entirety of the above-mentioned patent application is hereby incorporated by reference herein and made a part of specification.

BACKGROUND OF THE INVENTION

1. Field of the Invention

The present invention relates to a dimmer apparatus. More particularly, the present invention relates to a dimmer apparatus adapted to a light-emitting diode lamp.

2. Description of Related Art

A dimmer apparatus is generally applied to a lighting apparatus for controlling a power supply, so that not only a light-emitting device (for example, a bulb) of the lighting apparatus can be turned on/off, but also a light-emitting effect of the lighting apparatus can be fine-tuned. FIG. 1 is a diagram illustrating a conventional lighting apparatus. Referring to FIG. 1, the lighting apparatus 100 includes a power supply 102, a dimmer 104 and a bulb 106. The power supply 102 provides an input voltage, wherein the input voltage can be an alternating current (AC) power. When a user adjusts a light-emitting effect of the bulb 106 through the dimmer 104, the dimmer 104 can provide a voltage according to a conducting condition, so as to fine-tune the light-emitting effect of the bulb 106. Further, regarding a circuit structure, the light-emitting device (for example, a conventional tungsten bulb) of the conventional lighting apparatus generally has a characteristic as that of a resistor.

With a general technology trend of energy-saving and carbon reduction, a light-emitting diode (LED) lamp gradually becomes a main option for the light-emitting apparatus. Therefore, based on a cost consideration, in the related art, the bulb 106 is replaced by the LED lamp, while the power supply 102 and the dimmer 104 are not changed. Though, regarding the circuit structure, the LED lamp generally has a characteristic as that of a capacitor, so that when the user adjusts the brightness of the LED lamp through the dimmer 104, after the AC power output from the power supply 102 is conducted through the dimmer 104, the voltage provided by the dimmer 104 may result in a flickering phenomenon of the LED lamp.

SUMMARY OF THE INVENTION

The present invention is directed to a dimmer apparatus, which can receive an alternating current (AC) power from a dimmer to provide a stable driving voltage and driving current.

The present invention is directed to a lighting apparatus, which can receive an alternating current (AC) power from a dimmer to provide a stable driving voltage and driving current, and a light-emitting diode (LED) can provide a corresponding stable brightness according to the driving voltage and the driving current.

The present invention provides a dimmer apparatus adapted to receive an AC power to drive a LED. The dimmer apparatus includes a rectifier unit, a controller, a voltage divider and a voltage converter. The rectifier unit rectifies the AC power to generate a first operating voltage. The voltage divider is coupled to the first operating voltage for generating a voltage division corresponding to the first operating voltage.

The controller is coupled to the voltage divider for integrating the voltage division to obtain an average voltage, and outputting a pulse width modulation (PWM) signal according to the average voltage. The voltage converter is coupled between the controller and the LED for driving the LED, and adjusting a driving voltage and a driving current of the LED according to the PWM signal. Wherein, the controller further adjusts the PWM signal according to a feedback signal generated by the voltage converter.

In an embodiment of the present invention, the rectifier unit includes a rectifier, a filter and a regulator. The rectifier rectifies the AC power to generate the first operating voltage. The filter is coupled to an output of the rectifier, and is used for outputting a filtered voltage to the voltage converter. The regulator is coupled to an output of the filter, and is used for outputting a second operating voltage to the controller.

In an embodiment of the present invention, the rectifier unit includes a rectifier, a filter and a regulator. The rectifier rectifies the AC power to generate the first operating voltage to the voltage converter. The filter is coupled to an output of the rectifier, and is used for outputting a filtered voltage. The regulator is coupled to an output of the filter, and is used for outputting a second operating voltage to the controller.

In an embodiment of the present invention, the voltage converter is a buck circuit.

In an embodiment of the present invention, the controller is an application-specific integrated circuit (ASIC).

In an embodiment of the present invention, the AC power is an AC power adjusted by the dimmer.

The present invention provides a lighting apparatus, adapted to receive an AC power for lighting. The lighting apparatus includes a LED and a dimmer apparatus. The dimmer apparatus is coupled to the LED, and is used for converting the AC power to drive the LED. The dimmer apparatus includes a rectifier unit, a controller, a voltage divider and a voltage converter. The rectifier unit rectifies the AC power to generate a first operating voltage. The voltage divider is coupled to the first operating voltage for generating a voltage division corresponding to the first operating voltage. The controller is coupled to the voltage divider for integrating the voltage division to obtain an average voltage, and outputting a PWM signal according to the average voltage. The voltage converter is coupled between the controller and the LED for driving the LED, and adjusting a driving voltage and a driving current of the LED according to the PWM signal. Wherein, the controller further adjusts the PWM signal according to a feedback signal generated by the voltage converter.

Accordingly, the lighting apparatus of the present invention includes the dimmer apparatus and the LED, so that the lighting apparatus having the LED can be directly installed on a conventional lamp base, and a light brightness thereof can be adjusted by a conventional dimmer. The dimmer apparatus can receive the AC power provided by the dimmer, and can provide a stable driving voltage and driving current according to the PWM signal. The LED can correspondingly provide a stable brightness according to the driving voltage and the driving current. Accordingly, not only the brightness of the LED can be adjusted, but also a flickering phenomenon of the LED generated due to waveform variation of the AC power can be avoided.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
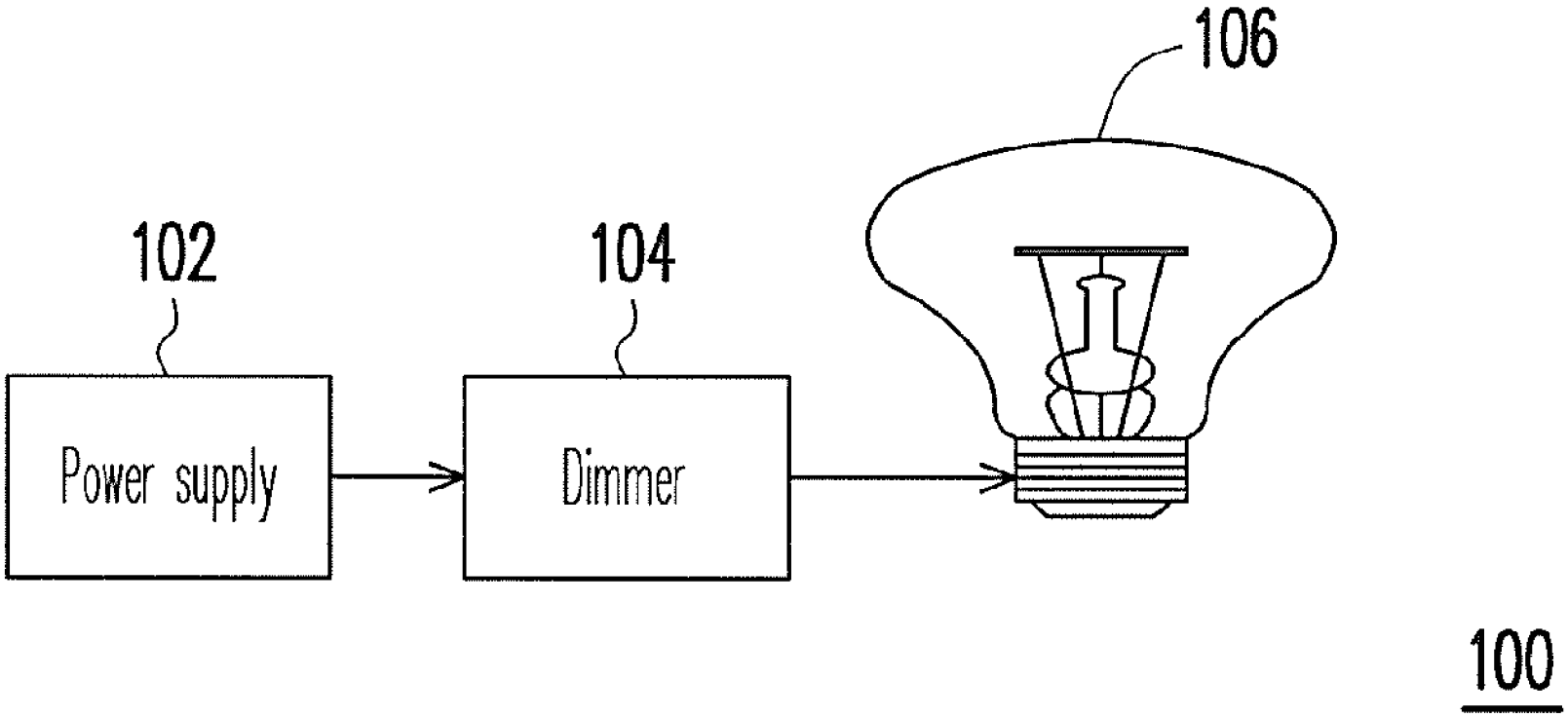
FIG. 1 is a diagram illustrating a conventional lighting apparatus.
Figure 2:
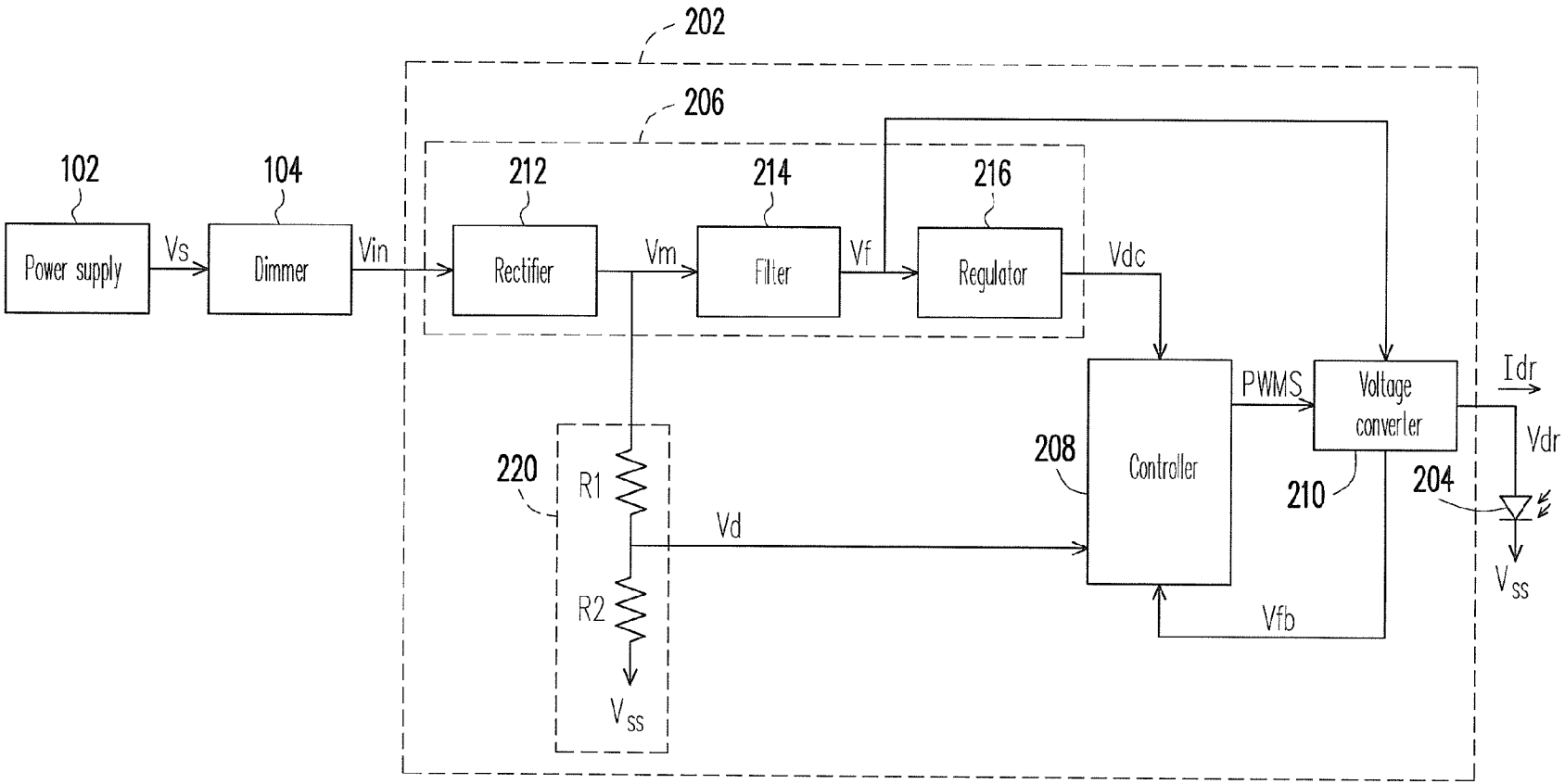
FIG. 2 is a diagram of a lighting apparatus according to an embodiment of the present invention.

FIG. 2 is a diagram of a lighting apparatus according to an embodiment of the present invention. Referring to FIG. 2, the lighting apparatus 200 includes a dimmer 104, a dimmer apparatus 202 and a light-emitting diode (LED) 204. The dimmer apparatus 202 includes a rectifier unit 206, a controller 208, a voltage converter 210 and a voltage divider 220. The dimmer 104 receives an input voltage Vs from a power 102, and outputs an alternating current (AC) power Vin according to a conducting condition. In the present embodiment, the dimmer 104 can be implemented by a tri-electrode AC switch (TRIAC), though the present invention is not limited thereto. Besides, the power 102 can be a local AC power or power provided by a power supply, which is not limited by the present invention.

The rectifier unit 206 rectifies the AC power Vin to generate a first operating voltage Vm. Since a power or voltage of the first operating voltage Vm may probably exceed a load of the controller 208, to protect the controller 208, the voltage divider 220 divides the first operating voltage Vm to generate a voltage division Vd, and transmits the voltage division Vd to the controller 208. On the other hand, the controller 208 generates a pulse width modulation (PWM) signal PWMS according to the voltage division Vd and a feedback signal Vfb provided by the voltage converter 210. Moreover, the voltage converter 210 can drive the LED 204, and can adjust a driving voltage Vdr and a driving current Idr of the LED 204 according to the PWM signal PWMS.

The rectifier unit 206 includes a rectifier 212, a filter 214 and a regulator 216. The rectifier 212 rectifies the AC power Vin to generate the first operating voltage Vm, and transmits the first operating voltage Vm to the filter 214. The filter 214 outputs a filtered voltage Vf to the voltage converter 210 and the regulator 216. The regulator 216 outputs a second operating voltage Vdc to the controller 208.

Figure 3:
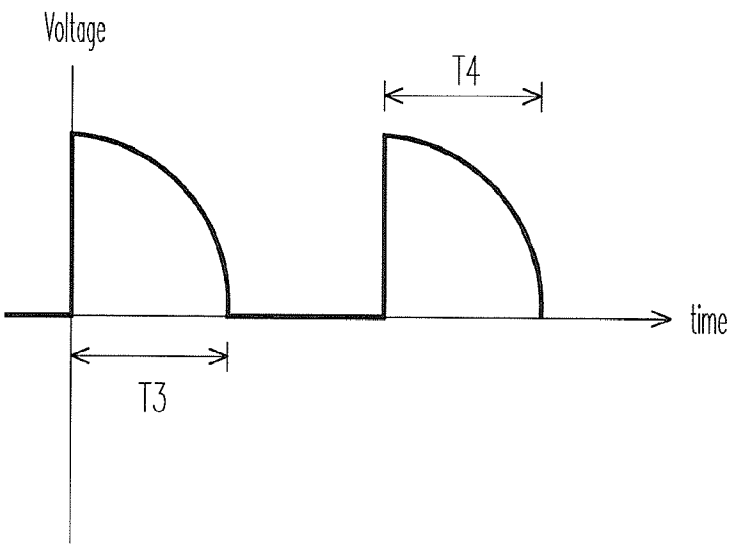
FIG. 3 is a waveform diagram of an AC power Vin.

In order to describe operations of the lighting apparatus 200 of the present embodiment in detail, waveform diagrams of related signals or voltages generated during operations of the lighting apparatus 200 are illustrated in FIG. 3 to FIG. 6. FIG. 3 is a waveform diagram of the AC power Vin. Referring to FIG. 3, the dimmer 104 adjusts a duty cycle and a waveform of the AC power Vin by adjusting a conducting condition of the TRAIC. In other words, the dimmer 104 can adjust half duty cycles T1 and T2 of the AC power Vin. Thereafter, the rectifier 212 rectifies the AC power Vin to provide the first operating voltage Vm, wherein a waveform of the first operating voltage Vm is as that shown in FIG. 4.

Figure 4:
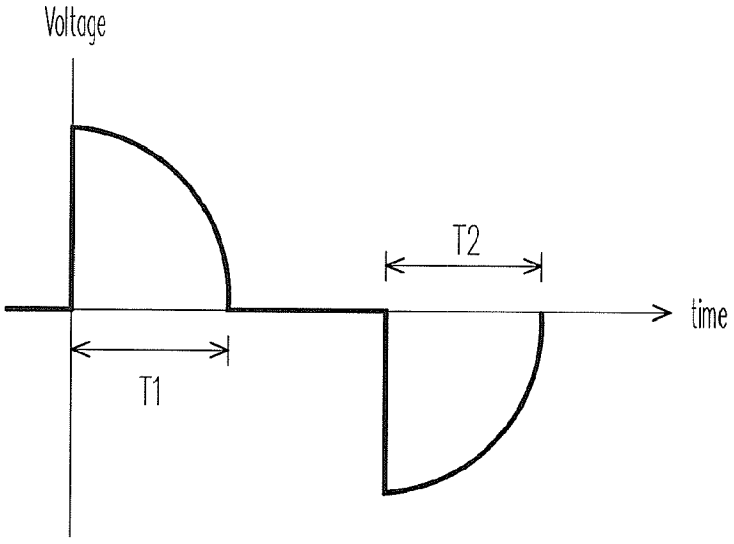
FIG. 4 is a waveform diagram of a first operating voltage Vm.

Further, referring to FIG. 3 and FIG. 4, when the duty cycles and the waveform of the AC power Vin are changed, the duty cycles and the waveform of the first operating voltage Vm are changed accordingly. In other words, the duty cycles T3 and T4 of the first operating voltage Vm correspond to a conducting waveform of the input voltage Vs, wherein the duty cycle T3 is varied along with the duty cycle T1, and the duty cycle T4 is varied along with the duty cycle T2. Accordingly, the driving voltage Vdr and the driving current Idr provided to the LED 204 by the rectifier unit 206 are also changed, so that the brightness of the LED 204 is adjusted. In the present embodiment, the rectifier 212 can be a bridge rectifier, though the present invention is not limited thereto.

Figure 5:
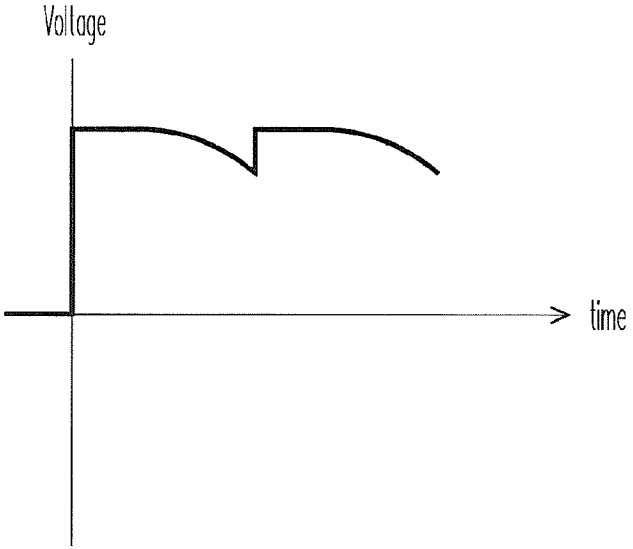
FIG. 5 is a waveform diagram of a filtered voltage Vf

Besides, the filter 214 receives and filters the first operating voltage Vm to output the filtered voltage Vf to the voltage converter 210, wherein a waveform of the filtered voltage Vf is as that shown in FIG. 5. Thereafter, the regulator 216 receives the filtered voltage Vf and outputs the second operating voltage Vdc for operating the controller 208.

In the present embodiment, since the power or the voltage of the first operating voltage Vm may probably exceed the load of the controller 208, the voltage divider 220 can output the voltage division Vd of the first operation voltage Vm, so as to protect the controller 208. The voltage divider 220 includes resistors R1 and R2. One end of the resistor R1 is coupled to the rectifier 212 for receiving the first operating voltage Vm, another end of the resistor R1 is coupled to one end of the resistor R2, and another end of the resistor R2 is coupled to the ground Vss, wherein a common node between the resistors R1 and R2 outputs the voltage division Vd.

Accordingly, the second operating voltage Vdc provide a power for operating the controller 208, and the controller 208 integrates the voltage division Vd to obtain an average voltage. By such means, the controller 208 can adjust the PWM signal PWMS according to the average voltage and the feedback signal Vfb generated by the voltage converter 210. In the present embodiment, the controller 208 can be implemented by an application-specific integrated circuit (ASIC), though the present invention is not limited thereto.

Figure 6:
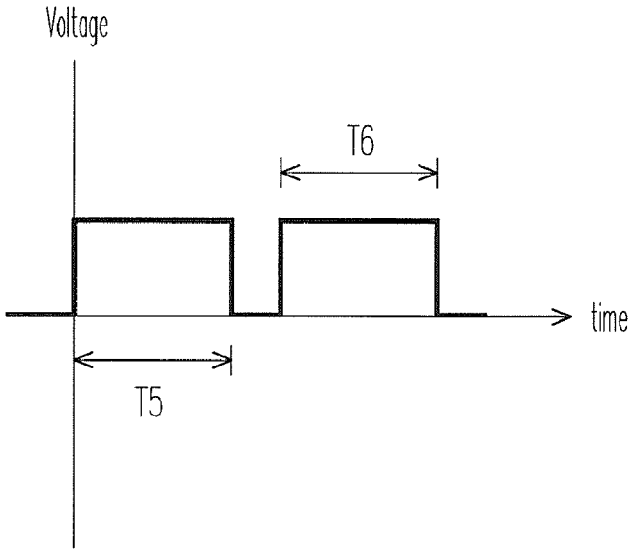
FIG. 6 is a waveform diagram of a PWM signal PWMS.

FIG. 6 is a waveform diagram of the PWM signal PWMS. The PWM signal PWMS has duty cycles T5 and T6. According to the above description, the controller 208 can integrate the voltage division Vd of the first operating voltage Vm to obtain the average voltage, and can output the PWM signal PWMS according to the average voltage.

On the other hand, the voltage converter 210 can adjust the driving voltage Vdr and the driving current Idr according to the PWM signal PWMS, so as to adjust the brightness of the LED 204. For example, when the duty cycles T5 and T6 are prolonged, the voltage converter 210 can output relatively higher driving voltage Vdr and driving current Idr, so that the LED 204 is brighter. Conversely, when the duty cycles T5 and T6 are shortened, the LED 204 can be darker due to relatively lower driving voltage Vdr and driving current Idr. One end of the LED 204 is coupled to an output of the voltage converter 210, and another end of the LED 204 is coupled to the ground Vss. Moreover, the driving voltage Vdr and the driving current Idr provided by the voltage converter 210 are relatively stable, so that the LED 204 can provide a stable brightness. Therefore, the flickering phenomenon is mitigated.

In the present embodiment, the voltage converter 210 can be a buck circuit, or can be implemented by a buck converter, though the present invention is not limited thereto. Besides, the voltage converter 210 can output the feedback signal Vfb to the controller 208, so that the controller 208 can adjust the PWM signal PWMS with reference of the feedback signal Vfb. The feedback signal Vfb includes states of the driving voltage Vdr and the driving current Idr output by the voltage converter 210.

According to the above descriptions, a user can adjust the brightness of the LED 204 through the dimmer 104 and the dimmer apparatus 202. The user can adjust the AC power Vin through the dimmer 104, so that the AC power Vin may have the duty cycles T1 and T2. The rectifier 212 rectifies the AC power Vin and outputs the first operating voltage Vm having the duty cycles T3 and T4, wherein the duty cycle T3 is varied along with the duty cycle T1, and the duty cycle T4 is varied along with the duty cycle T2. Thereafter, the controller 208 can integrate the voltage division Vd to obtain the average voltage, and can accordingly provide the PWM signal PWMS to the voltage converter 210.

Finally, the voltage converter 210 can provide the stable driving voltage Vdr and the driving current Idr, so that the LED 204 can provide a stable brightness, and the flickering phenomenon can be mitigated. By such means, when the AC power Vin received by the rectifier 212 is changed, the driving voltage Vdr and the driving current Idr provided by the voltage converter 210 can be correspondingly varied along with the duty cycles T5 and T6 of the PWM signal PWMS, so that the brightness of the LED 204 is accordingly changed, and therefore a function of adjusting the brightness of the LED 204 is achieved.

Figure 7:
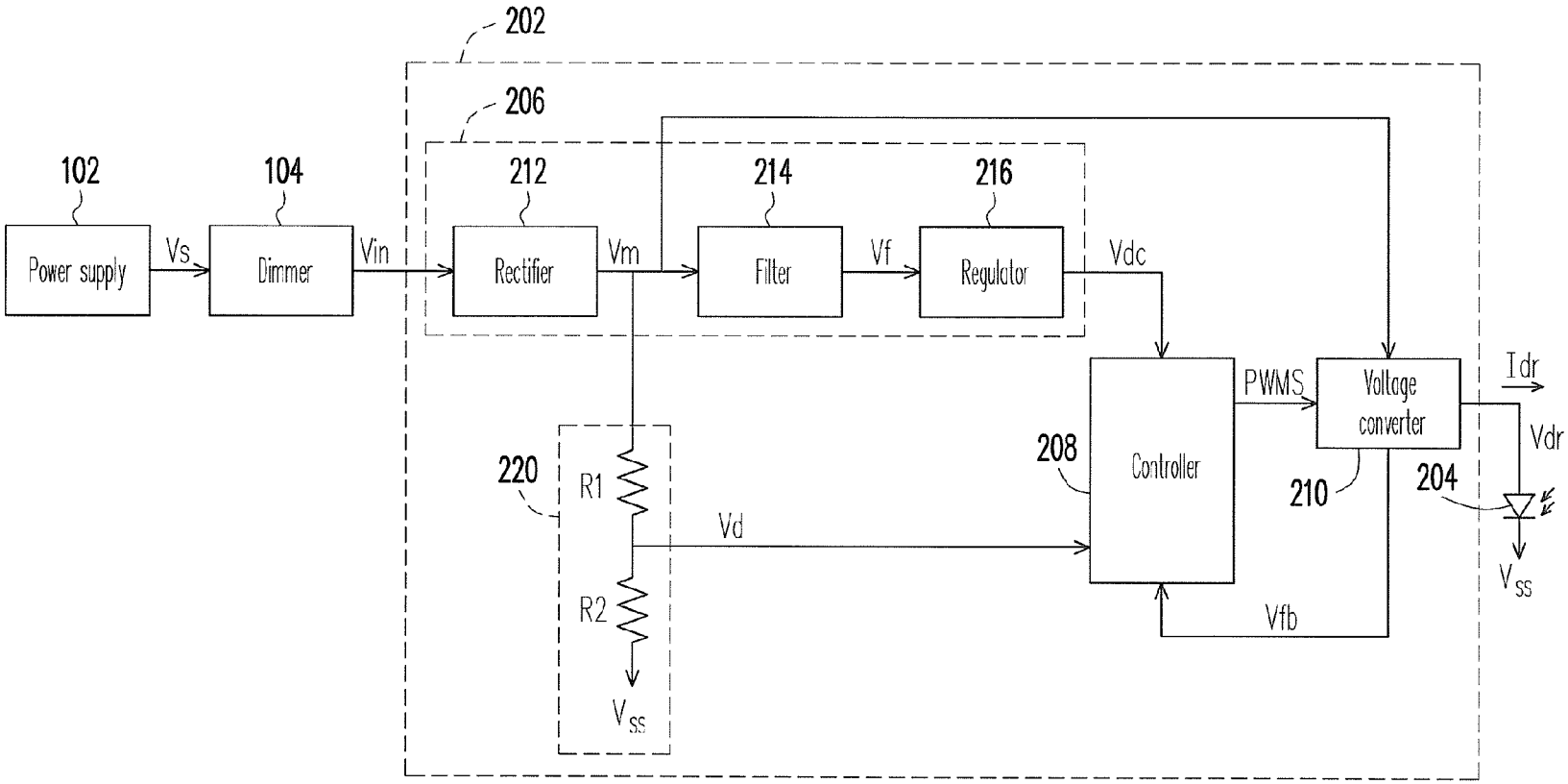
FIG. 7 is a diagram of a lighting apparatus according to another embodiment of the present invention.

Besides the embodiment of FIG. 2, another embodiment is provided below for further understanding of the present invention. FIG. 7 is a diagram of a lighting apparatus according to another embodiment of the present invention. Referring to FIG. 7, the related components, voltages and signals are similar as that of FIG. 2, and therefore detail descriptions thereof are not repeated. A difference between the embodiment of FIG. 7 and the embodiment of FIG. 2 is that the voltage converter 210 of FIG. 7 receives the first operating voltage Vm from the rectifier 212, and adjusts the driving voltage Vdr and the driving current Idr according to the PWM signal PWMS, so as to adjust the brightness of the LED 204.

In summary, the lighting apparatus of the present invention includes the dimmer apparatus and the LED, so that the lighting apparatus having the LED can be directly installed on a conventional lamp base, and a light brightness thereof can be adjusted by a conventional dimmer. The dimmer apparatus can rectify the AC power provided by the dimmer. The controller integrates the voltage division of the first operation voltage to obtain the average voltage, and outputs the PWM signal according to the average voltage, so as to adjust to the voltage converter, so that the voltage converter can provide a stable driving voltage and driving current to the LED. By such means, not only the brightness of the LED can be adjusted, but also the flickering phenomenon of the LED generated due to waveform variation of the AC power can be avoided.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A dimmer apparatus, adapted to receive an AC power to drive a light-emitting diode (LED), comprising:

a rectifier unit, rectifying the AC power to generate a first operating voltage;

a voltage divider, coupled to the first operating voltage for generating a voltage division corresponding to the first operating voltage;

a controller, coupled to the voltage divider for integrating the voltage division to obtain an average voltage, and outputting a pulse width modulation (PWM) signal according to the average voltage; and a voltage converter, coupled between the controller and the LED for driving the LED, and adjusting a driving voltage and a driving current of the LED according to the PWM signal, wherein the controller further adjusts the PWM signal according to a feedback signal generated by the voltage converter, wherein the rectifier unit comprises:

a rectifier, rectifying the AC power to generate the first operating voltage;

a filter, coupled to an output of the rectifier, for outputting a filtered voltage; and a regulator, coupled to an output of the filter, for outputting a second operating voltage to the controller.

2. The dimmer apparatus as claimed in claim 1, wherein the filter is further coupled to the voltage converter for outputting the filtered voltage to the voltage converter.

3. The dimmer apparatus as claimed in claim 1, wherein the rectifier is further coupled to the voltage converter for generating the first operating voltage to the voltage converter.

4. The dimmer apparatus as claimed in claim 1, wherein the voltage converter is a buck circuit.

5. The dimmer apparatus as claimed in claim 1, wherein the controller is an application-specific integrated circuit (ASIC).

6. The dimmer apparatus as claimed in claim 1, wherein the AC power is an AC power adjusted by a dimmer, and the dimmer comprises a tri-electrode AC switch (TRIAC).

7. A lighting apparatus, adapted to receive an AC power for lighting, comprising:

an LED; and a dimmer apparatus, coupled to the LED, for converting the AC power to drive the LED, and the dimmer apparatus comprising:

a rectifier unit, rectifying the AC power to generate a first operating voltage;

a voltage divider, coupled to the first operating voltage for generating a voltage division corresponding to the first operating voltage;

a controller, coupled to the voltage divider for integrating the voltage division to obtain an average voltage, and outputting a PWM signal according to the average voltage; and a voltage converter, coupled between the controller and the LED for driving the LED, and adjusting a driving voltage and a driving current of the LED according to the PWM signal, wherein the controller further adjusts the PWM signal according to a feedback signal generated by the voltage converter, wherein the rectifier unit comprises:

a rectifier, rectifying the AC power to generate the first operatingvoltage a filter, coupled to an output of the rectifier, for outputting a filtered voltage; and a regulator, coupled to an output of the filter, for outputting a second operating voltage to the controller.

8. The lighting apparatus as claimed in claim 7, wherein the filter is further coupled to the voltage converter for outputting the filtered voltage to the voltage converter.

9. The lighting apparatus as claimed in claim 7, wherein the rectifier is further coupled to the voltage converter for generating the first operating voltage to the voltage converter.

10. The lighting apparatus as claimed in claim 7, wherein the voltage converter is a buck circuit.

11. The lighting apparatus as claimed in claim 7, wherein the controller is an ASIC.

12. The lighting apparatus as claimed in claim 7, wherein the AC power is an AC power adjusted by a dimmer, and the dimmer comprises a tri-electrode AC switch (TRIAC).

* * * * *